US007586055B2

(12) United States Patent
Jones et al.

(10) Patent No.: US 7,586,055 B2
(45) Date of Patent: Sep. 8, 2009

(54) OVER RUNNING CLUTCH FOR A DIRECT DRIVE MOTOR OPERATOR

(75) Inventors: William J. Jones, Cranberry Township, PA (US); Craig A. Rodgers, Butler, PA (US); Erik R. Bogdon, Carnegie, PA (US); James M. Smeltzer, Salem, OH (US)

(73) Assignee: Eaton Corporation, Cleveland, OH (US)

( * ) Notice: Subject to any disclaimer, the term of this patent is extended or adjusted under 35 U.S.C. 154(b) by 325 days.

(21) Appl. No.: 11/733,449

(22) Filed: Apr. 10, 2007

(65) Prior Publication Data

US 2008/0251342 A1 Oct. 16, 2008

(51) Int. Cl.
*H01H 5/00* (2006.01)

(52) U.S. Cl. ..... 200/400

(58) Field of Classification Search ..... 200/400, 200/401, 500, 501

See application file for complete search history.

(56) References Cited

U.S. PATENT DOCUMENTS 4,146,764 A * 3/1979 Wilson ..... 200/400
4,245,140 A * 1/1981 Jencks et al. ..... 200/400
5,651,451 A * 7/1997 Castonguay et al. ..... 200/400
5,910,650 A * 6/1999 Castonguay et al. ..... 200/400
5,938,008 A * 8/1999 Wehrli et al. ..... 200/400
6,064,021 A * 5/2000 Wehrli et al. ..... 200/400
7,009,130 B2 * 3/2006 Hashimoto et al. ..... 200/400
7,411,145 B1 * 8/2008 Jones et al. ..... 200/400
7,518,076 B1 * 4/2009 Gottschalk et al. ..... 200/400

* cited by examiner

*Primary Examiner*—Michael A Friedhofer
(74) *Attorney, Agent, or Firm*—Martin J. Moran

(57) ABSTRACT

An over running clutch assembly for an electrical switching apparatus is provided. The over running clutch assembly includes a sprocket and a hub assembly. The hub assembly is rotatably coupled to the sprocket and structured to rotate in a charging direction relative to the sprocket. The sprocket is fixed to a motor shaft. The hub assembly is structured to be disengagably fixed to a cam shaft in the charging assembly. A manual charging handle is also coupled to the cam shaft and is structured to rotate the cam shaft in a charging direction. In this configuration, an operator may charge the closing springs of the electrical switching apparatus using either the handle assembly or the motor. When the handle assembly is used to charge the closing springs, the cam shaft causes the hub assembly to rotate over the sprocket. Thus, the rotation of the cam shaft is not transferred to the motor. When the motor is used, the motor turns both the sprocket and the hub assembly. The hub assembly transfers the rotational force from the motor to the cam shaft.

18 Claims, 6 Drawing Sheets

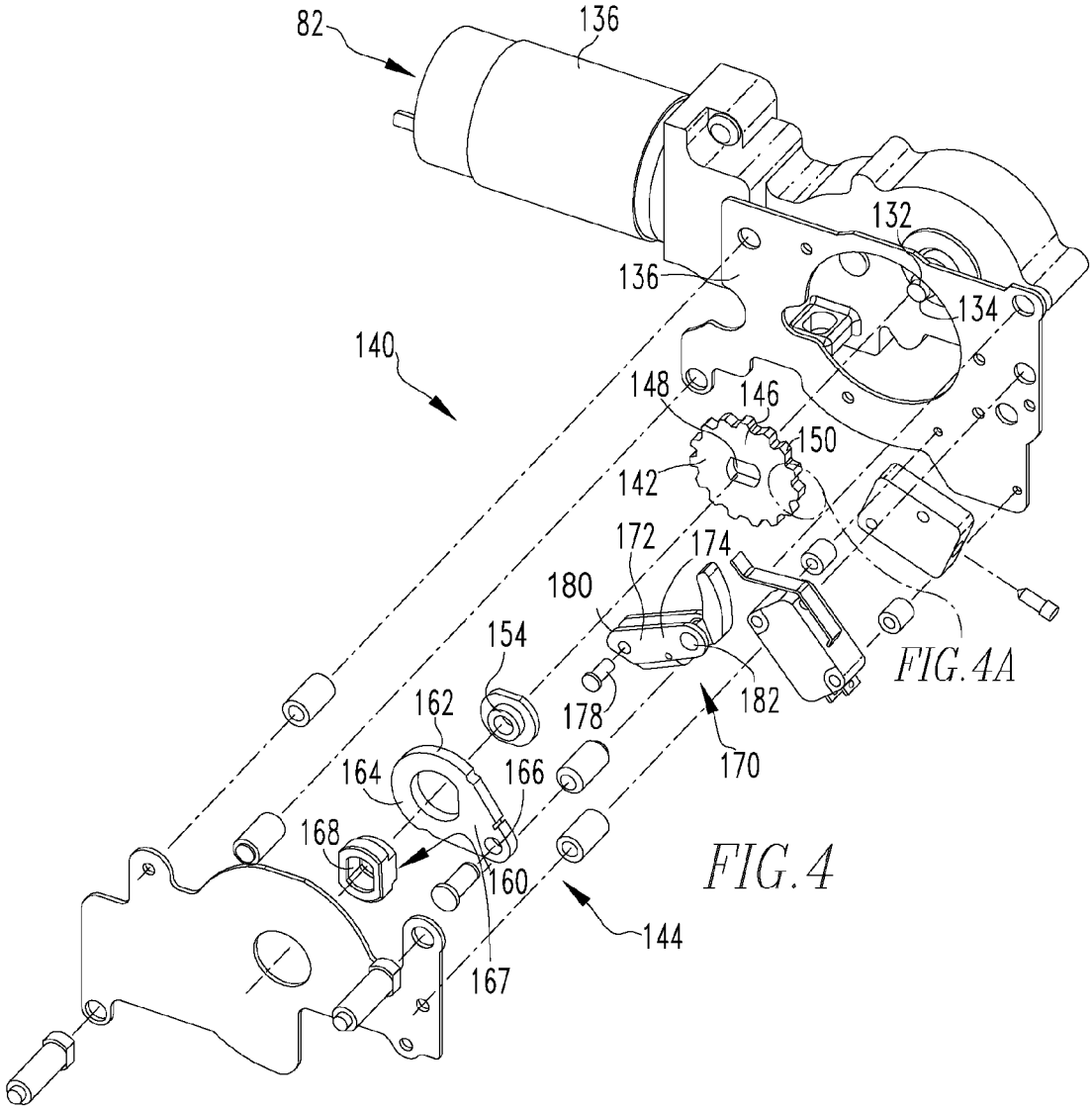
FIG. 4A
FIG. 4
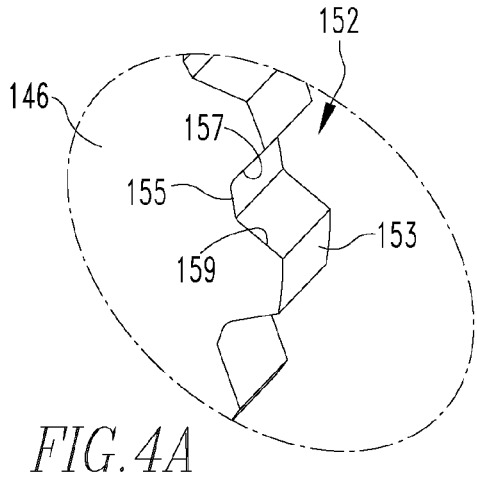
FIG. 4A

OVER RUNNING CLUTCH FOR A DIRECT DRIVE MOTOR OPERATOR

CROSS REFERENCE TO RELATED APPLICATION

This application is related to commonly assigned, concurrently filed U.S. patent application Ser. No. 11/733,465, filed Apr. 10, 2007, entitled "MOTOR OPERATOR DE-COUPLING SYSTEM SENSING CAMSHAFT POSITION", and which is incorporated by reference.

BACKGROUND OF THE INVENTION

1. Field of the Invention

The present invention relates to an electrical switching apparatus operating mechanism and, more specifically to an over running clutch disposed between the operating mechanism charging motor and the operating mechanism charging handle.

2. Background Information

An electrical switching apparatus, typically, includes a housing, at least one bus assembly having a pair of contacts, a trip device, and an operating mechanism. The housing assembly is structured to insulate and enclose the other components. The at least one pair of contacts include a fixed contact and a movable contact and typically include multiple pairs of fixed and movable contacts. Each contact is coupled to, and in electrical communication with, a conductive bus that is further coupled to, and in electrical communication with, a line or a load. A trip device is structured to detect an over current condition and to actuate the operating mechanism. The operating mechanism is structured to both open the contacts, either manually or following actuation by the trip device, and close the contacts.

That is, the operating mechanism includes both a closing assembly and an opening assembly, which may have common elements, that are structured to move the movable contact between a first, open position, wherein the contacts are separated, and a second, closed position, wherein the contacts are coupled and in electrical communication. The operating mechanism includes a rotatable pole shaft that is coupled to the movable contact and structured to move each movable contact between the closed position and the open position. Elements of both the closing assembly and the opening assembly are coupled to the pole shaft so as to effect the closing and opening of the contacts.

An electrical switching apparatus typically had a stored energy device, such as at least one opening spring, and at least one link coupled to the pole shaft. The at least one link, typically, included two links that acted cooperatively as a toggle assembly. When the contacts were open, the toggle assembly was in a first, collapsed configuration and, conversely, when the contacts were closed, the toggle assembly was, typically, in a second, toggle configuration or in a slightly over-toggle configuration. The spring biased the toggle assembly to the collapsed configuration. The spring and toggle assembly were maintained in the second, toggle configuration by the trip device.

The trip device included an over-current sensor, a latch assembly and may have included one or more additional links that were coupled to the toggle assembly. Alternately, the latch assembly was directly coupled to the toggle assembly. When an over-current situation occurred, the latch assembly was released allowing the opening spring to cause the toggle assembly to collapse. When the toggle assembly collapsed, the toggle assembly link coupled to the pole shaft caused the pole shaft to rotate and thereby move the movable contacts into the open position.

Typically, the force required to close the contacts was, and is, greater than what a human may easily apply. As such, the operating mechanism typically included a mechanical closing assembly to close the contacts. The closing assembly, typically, included at least one stored energy device, such as a spring, and/or a motor. A common configuration included a motor that compressed one or more springs in the closing assembly. That is, the closing springs were coupled to a cam roller that engaged a cam coupled to the motor. As the motor rotated the cam, the closing springs were compressed or charged. The closing springs were maintained in the compressed configuration by a latch assembly. The latch assembly was actuated by a user to initiate a closing procedure. The closing assembly is structured to apply the energy stored in the springs to the toggle assembly so as to cause the pole shaft to rotate and close the contacts.

In many electrical switching apparatuses the springs are coupled to the toggle assembly via a cam roller. That is, the toggle assembly also included a cam roller, typically at the toggle joint. The closing assembly further included one or more cams disposed on a common cam shaft with the closing spring cam. Alternatively, depending upon the configuration of the cam, both the closing spring cam roller and the toggle assembly cam roller could engage the same cam. When the closing springs were released, the closing spring cam roller applied force to the associated cam and caused the cam shaft to rotate. Rotation of the cam shaft would also cause the cam associated with the toggle assembly cam roller to rotate. As the cam associated with the toggle assembly cam roller rotated, the cam caused the toggle assembly cam roller, and therefore the toggle assembly, to be moved into selected positions and/or configurations. Alternatively, as set forth in U.S. patent application Ser. No. 11/693,159, which is incorporated by reference, the springs could be coupled to a ram assembly having a ram body that moved over a predetermined path. The ram body was structured to directly engage the toggle assembly and move the toggle assembly into a selected position. That is, whether the closing assembly utilized a cam or a ram assembly, the toggle assembly was moved so as to rotate the pole shaft into a position wherein the contacts were closed.

For example, during a closing procedure the toggle assembly would initially be collapsed and, therefore, the contacts were open. When the closing springs were released, the rotation of the cam associated with the toggle assembly cam roller would cause the toggle assembly to move back into the second, toggle position, thereby closing the contacts. This motion would also charge the opening springs. Simultaneously, or near simultaneously, the trip device latch would be reset thereby holding the toggle assembly in the second, toggle position. After the contacts were closed, it was common to recharge the closing spring so that, following an over current trip, the contacts could be rapidly closed again. That is, if the closing springs were charged, the contacts could be closed almost immediately without having to wait to charge the closing springs.

As noted above, the charging of the closing springs was typically accomplished via a motor. The motor had an output shaft that was coupled, directly or indirectly, to the shaft of the charging cam. In addition to the charging motor, most electrical switching apparatuses included an elongated manual charging handle. The charging handle also acted upon the shaft of the charging cam either directly or indirectly. To prevent the charging handle from applying torque to the motor when the handle was used to charge the closing springs, a clutch was disposed between the motor and the handle.

A common type of clutch utilized in closing assemblies was a reciprocal drive clutch. While such a reciprocal drive clutch functioned well, it does have several disadvantages. First, the reciprocal drive clutch included a number of components which were all subject to wear and tear. Further, the reciprocal drive clutch typically was very noisy, due to non-symmetrical loading. While the noise level does not effect the operation of the device, users could misinterpret the noise level as a mechanical problem. Thus, the noise level is a user perception issue. Similarly, the use of an over running clutch during a motor charging operation allowed the handle to vibrate. Again, this does not effect the operation of the closing assembly, but creates a poor user impression.

There is, therefore, a need for an over running clutch assembly having a reduced number of components.

There is a further need for an over running clutch assembly structured to operate in a manner with limited observable or audible indications.

SUMMARY OF THE INVENTION

These needs, and others, are met by the at least one embodiment of the present invention which discloses an over running clutch assembly for an electrical switching apparatus. The over running clutch assembly includes a sprocket and a hub assembly. The hub assembly is rotatably coupled to the sprocket and structured to rotate in a charging direction relative to the sprocket. The sprocket is fixed to a motor shaft. The hub assembly is structured to be disengagably fixed to a cam shaft in the charging assembly. A manual charging handle is also coupled to the cam shaft and is structured to rotate the cam shaft in a charging direction. In this configuration, an operator may charge the closing springs of the electrical switching apparatus using either the handle assembly or the motor. When the handle assembly is used to charge the closing springs, the cam shaft causes the hub assembly to rotate over the sprocket. Thus, the rotation of the cam shaft is not transferred to the motor. When the motor is used, the motor turns both the sprocket and the hub assembly. The hub assembly transfers the rotational force from the motor to the cam shaft.

BRIEF DESCRIPTION OF THE DRAWINGS

A full understanding of the invention can be gained from the following description of the preferred embodiments when read in conjunction with the accompanying drawings in which:

FIG. 2A shows the springs in a discharged position. FIG. 2B shows the springs in a charged position.

FIG. 4 shows an exploded view of an over running clutch assembly.

FIG. 4A shows a detail of the sprocket.

DESCRIPTION OF THE PREFERRED EMBODIMENTS

As used herein, "coupled" means a link between two or more elements, whether direct or indirect, so long as a link occurs.

As used herein, "directly coupled" means that two elements are directly in contact with each other.

As used herein, "fixedly coupled" or "fixed" means that two components are coupled to move as one. Components that are "fixed" to each other may be "permanently fixed" to each other by a coupling device such as, but not limited to, welding or a difficult to access bolt. Components may also be "disengagably fixed" to each other by a coupling device that, when joined, maintains the components in a set orientation relative to each other, but which may be decoupled. For example, a socket wrench typically includes a ratchet/handle with a rotatable square shaft structured to be "disengagably fixed" to a socket.

Figure 1:
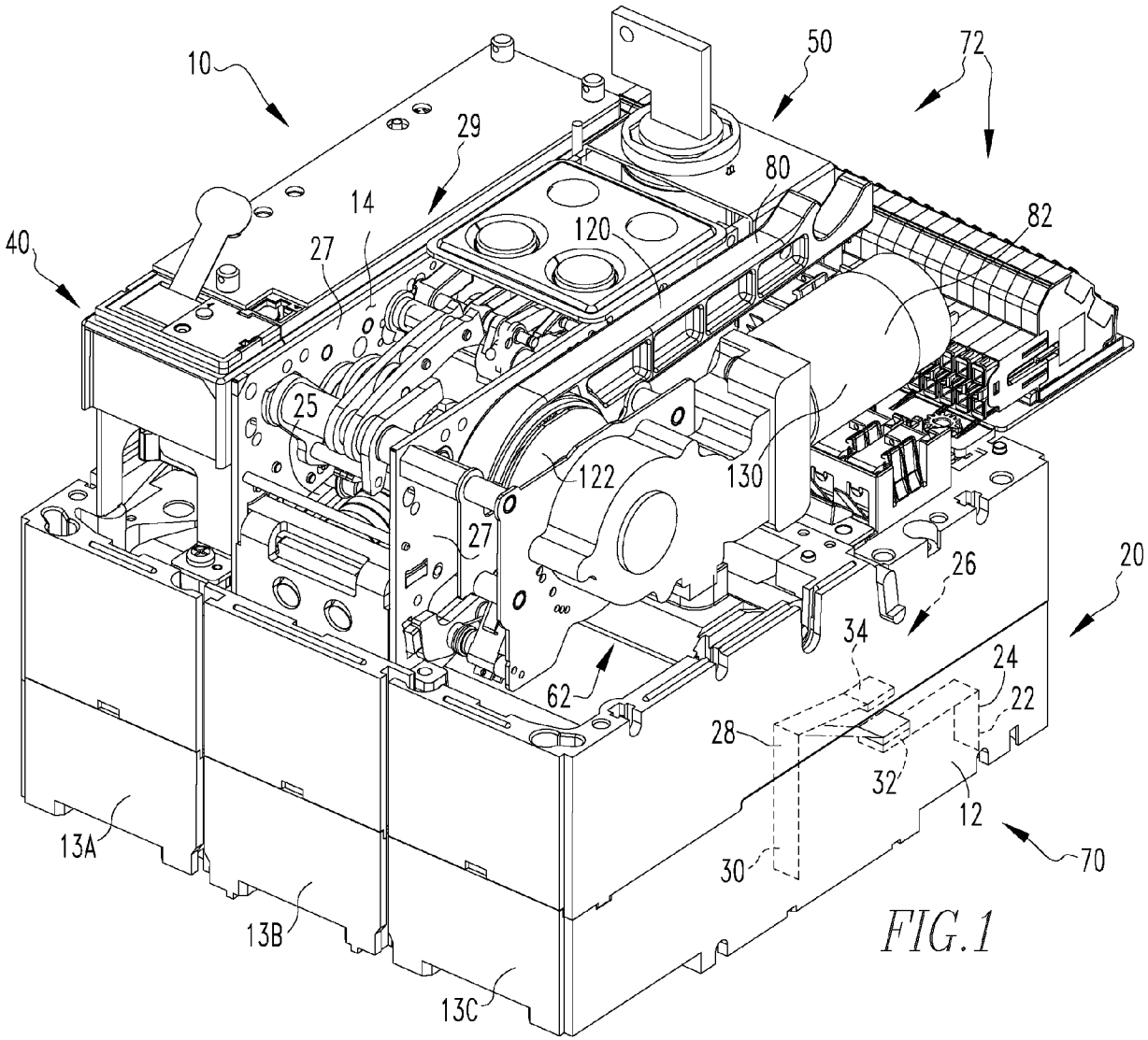
FIG. 1 is an isometric view of a electrical switching apparatus with a front cover removed.

As shown in FIG. 1, an electrical switching apparatus 10 includes a housing assembly 12 defining an enclosed space 14. In FIG. 1, the front cover of the housing assembly 12 is not shown, but it is well known in the art. The electrical switching apparatus 10 further includes a conductor assembly 20 (shown schematically) having at least one line terminal 22, at least one line conductor 24, at least one pair of separable contacts 26, at least one load conductor 28 and at least one load terminal 30. The at least one pair of separable contacts 26 include a fixed contact 32 and a movable contact 34. The movable contact 34 is structured to move between a first, open position, wherein the contacts 32, 34 are separated, and a second, closed position, wherein the contacts 32, 34 contact each other and are in electrical communication. The electrical switching apparatus 10 further includes a trip device 40 and an operating mechanism 50. The operating mechanism 50 is generally structured to move the at least one pair of separable contacts 26 between the first, open position and the second, closed position. The trip device 40 is structured to detect an over current condition and, upon detecting such a condition, to actuate the operating mechanism 50 to open the at least one pair of separable contacts 26.

The electrical switching apparatus 10 also includes at least two, and typically a plurality, of side plates 27. The side plates 27 are disposed within the housing assembly 12 in a generally parallel orientation. The side plates 27 include a plurality of openings 29 to which other components may be attached or through which other components may extend. As discussed below, the openings 29 on two adjacent side plates 27 are typically aligned. While side plates 27 are the preferred embodiment, it is understood that the housing assembly 12 may also be adapted to include the required openings and/or attachment points thereby, effectively, incorporating the side plates 27 into the housing assembly 12 (not shown).

An electrical switching apparatus 10 may have one or more poles, that is, one or more pairs of separable contacts 26 each having associated conductors and terminals. As shown in the Figures the housing assembly 12 includes three chambers 13A, 13B, 13C each enclosing a pair of separable contacts 26 with each being a pole for the electrical switching apparatus 10. A three-pole configuration, or a four-pole configuration having a neutral pole, is well known in the art. The operating mechanism 50 is structured to control all the pairs of separable contacts 26 within the electrical switching apparatus 10. Thus, it is understood selected elements of the operating mechanism 50, such as, but not limited to, the pole shaft 56 span all three chambers 13A, 13B, 13C and engage each pair of separable contacts 26. The following discussion, however, shall not specifically address each specific pair of separable contacts 26.

Figure 2:
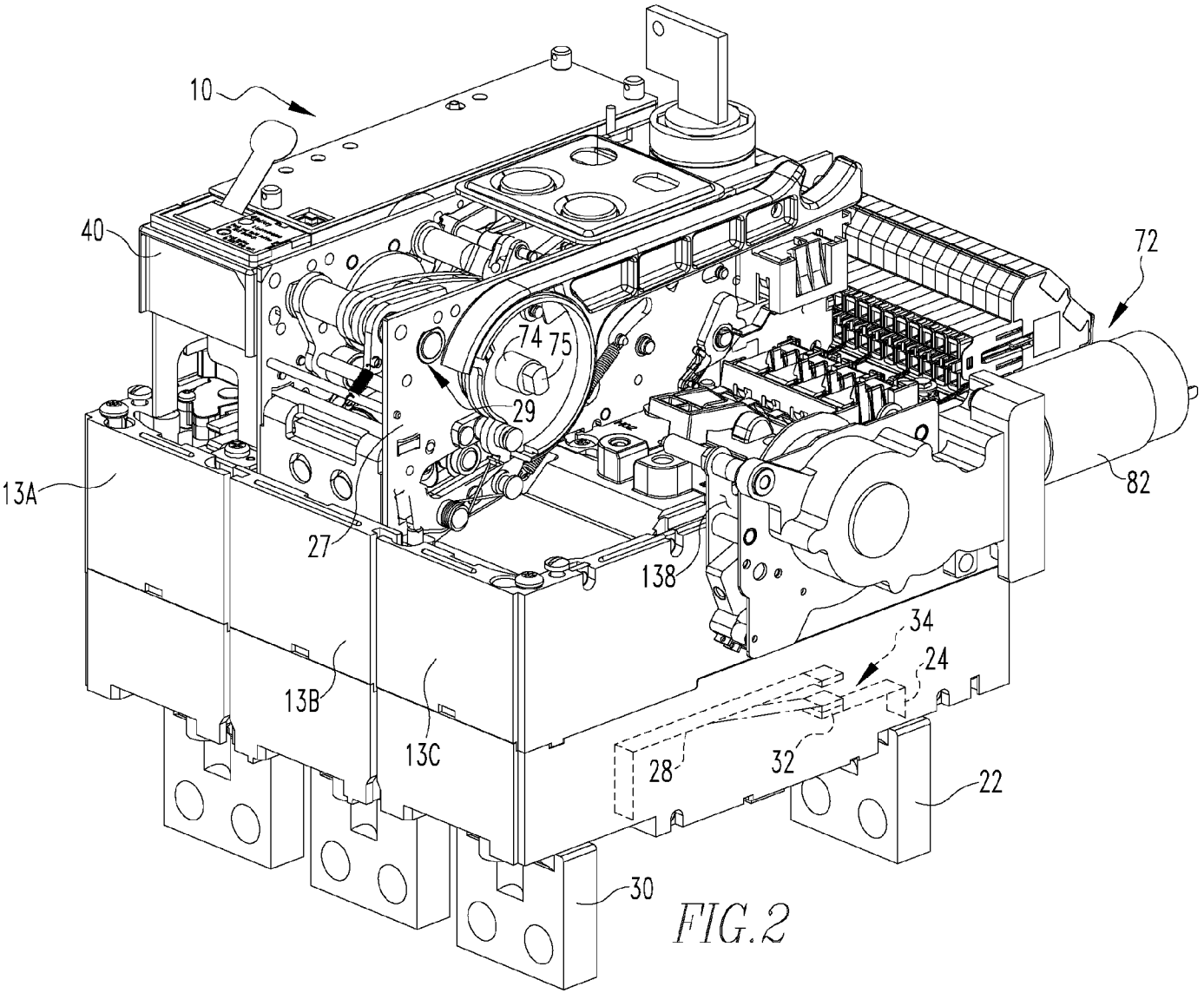
FIG. 2 is an isometric view of a electrical switching apparatus with a front cover, motor assembly and handle assembly removed.
Figure 3A:
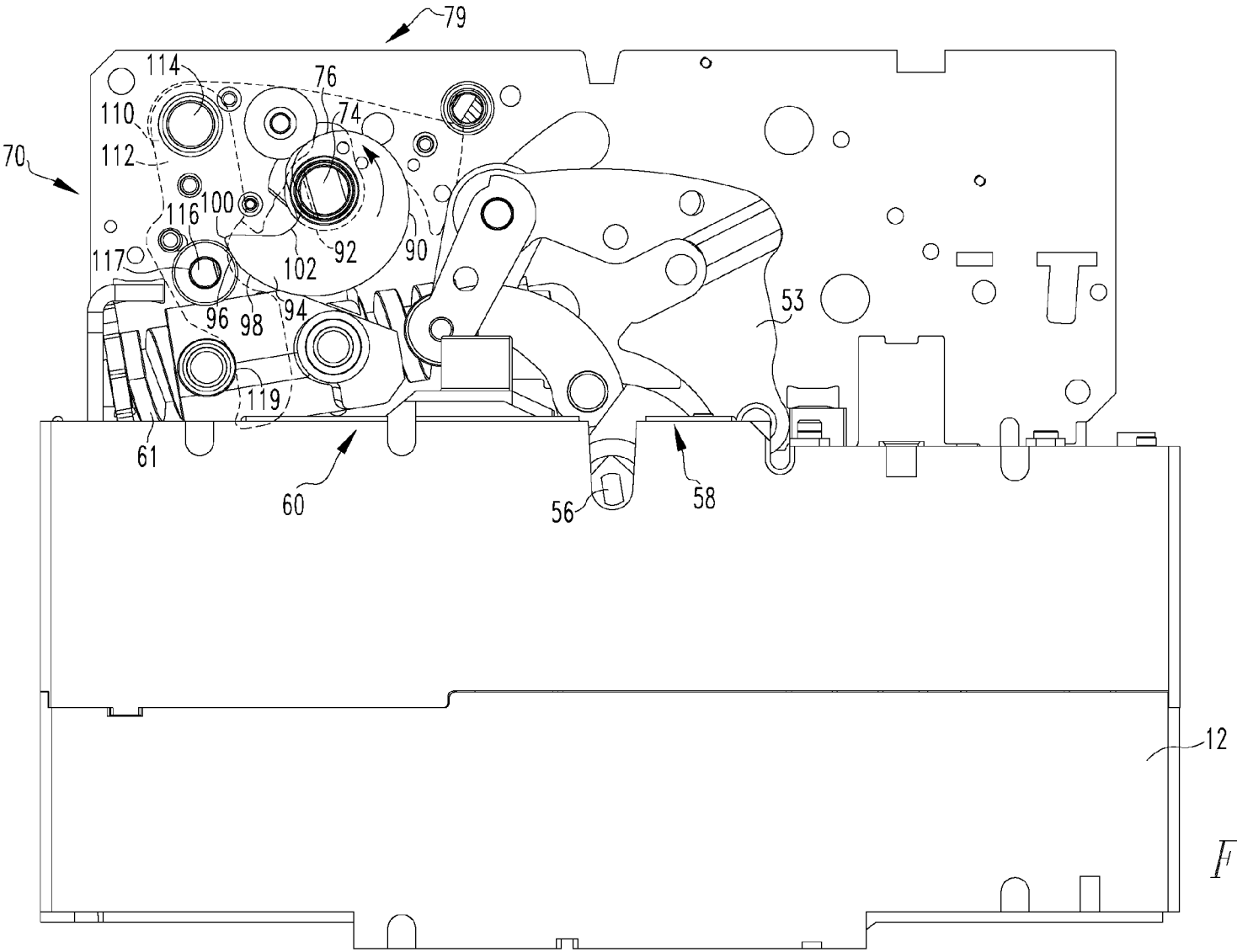
FIGS. 3A and 3B are side views of a electrical switching apparatus with a front cover removed and selected components removed for clarity.
Figure 3B:
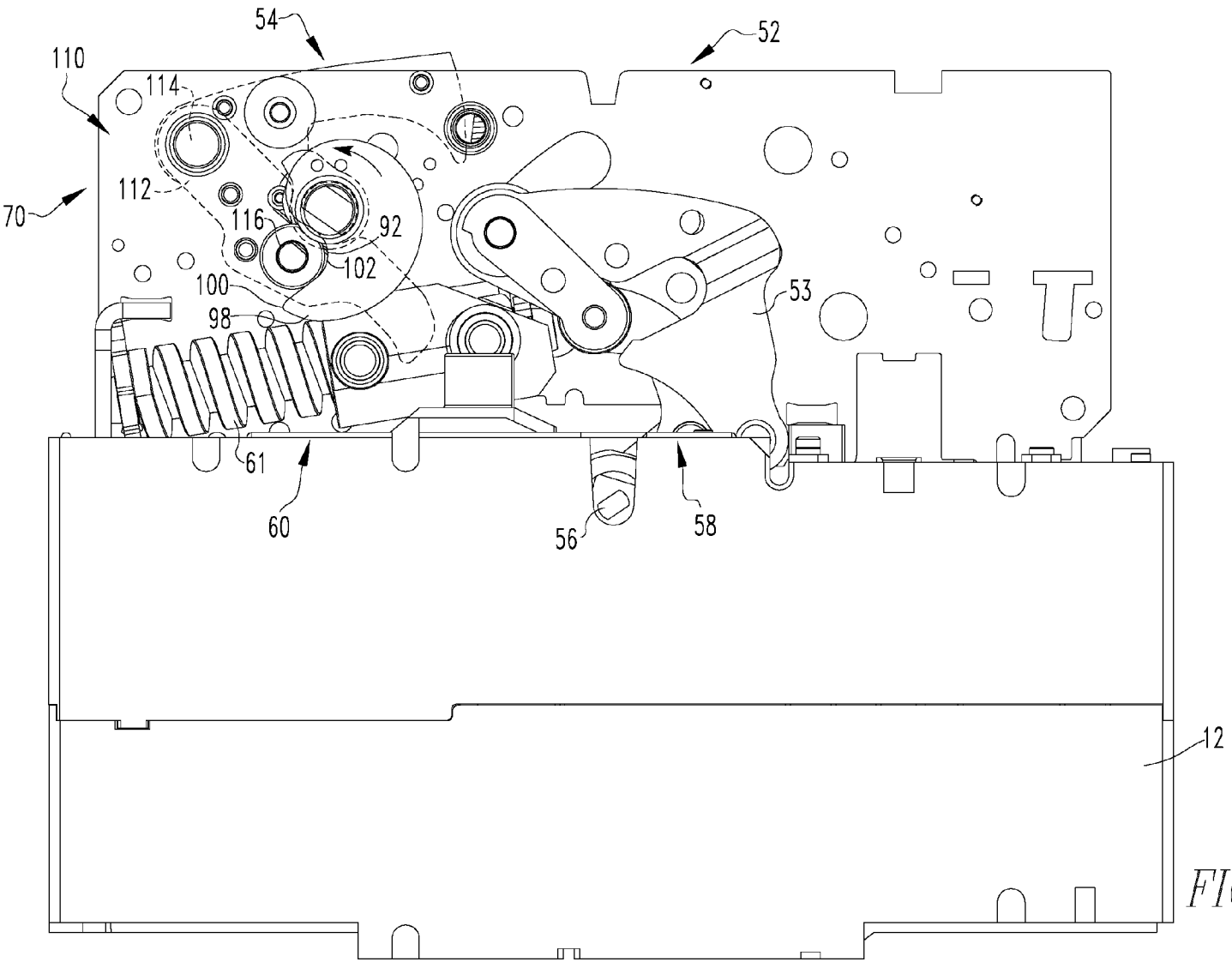
Figure 5:
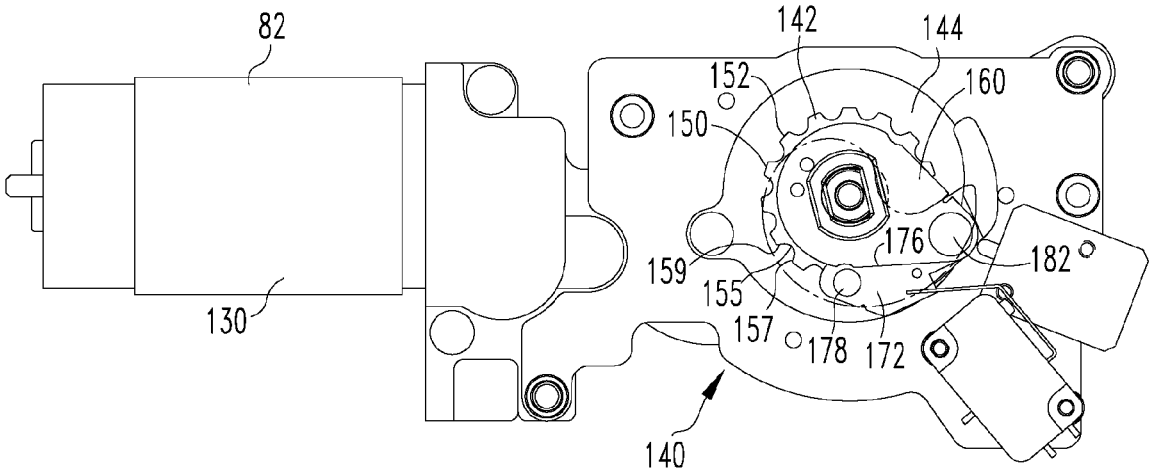
FIG. 5 shows an end view of selected components of the charging assembly.

As shown in FIG. 2, the operating mechanism 50 includes an opening assembly 52, structured to move the at least one pair of separable contacts 26 from the second, closed position to the first, open position, and a closing assembly 54, structured to move the at least one pair of separable contacts 26 from the first, open position to the second closed position. The opening assembly 52 and the closing assembly 54 both utilize common components of the operating mechanism 50. The opening assembly 52 is not part of the claimed invention, however, for the purpose of the following discussion, it is understood that the opening assembly 52 is the assembly structured to move various components to the positions discussed below. Further, it is noted that the opening assembly 52 includes a cradle assembly 53 that, among other functions, acts as a toggle stop and as a toggle kicker for the toggle assembly 58 (discussed below).

Further details relating to the operation of the closing assembly 54 are set forth in U.S. patent application Ser. No. 11/693,159, which, as noted above, is incorporated by reference. That is, as discussed in U.S. patent application Ser. No. 11/693,159, the closing assembly 54 utilizes a ram assembly 60 structured to act upon a toggle assembly 62 wherein the toggle assembly 62 is coupled via a pole shaft 56 to the movable contacts 34. The ram assembly 60 utilizes energy stored in at least one closing spring 61. The at least one closing spring 61 is structured to move between a charged and a discharged configuration. The at least one closing spring 61 is compressed, or "charged," by the charging assembly 70 detailed herein.

As shown in FIGS. 1 and 2, the charging assembly 70 includes a charging operator 72, a cam shaft 74, at least one cam 76, and a rocker arm assembly 110. The charging operator 72 is a device coupled to, and structured to rotate, the cam shaft 74. The charging operator 72, preferably, includes both a manually powered handle assembly 80 and a powered motor assembly 82 as shown in FIG. 1. The cam shaft 74 is an elongated shaft that is rotatably coupled to the housing assembly 12 and/or side plates 27. The at least one cam 76 is fixed to the cam shaft 74 and structured to rotate therewith about a pivot point. The cam shaft 74 has a distal tip 75 that is spaced from the least one cam 76. The cam shaft distal tip 75 has a non-circular shape which is, preferably a D-shape as shown.

The at least one cam 76, which hereinafter will be referred to as a single cam, includes an outer cam surface 90. The outer cam surface 90 has a point of minimal diameter 92, a point of greatest diameter 94, also known as "top dead center" of the cam 76, and a stop diameter 96. The cam 76 is structured to rotate in a single direction as indicated by the arrow in FIG. 2. The outer cam surface 90 increases gradually in diameter from the point of minimal diameter 92 to the point of greatest diameter 94 in the direction of rotation. After the cam point of greatest diameter 94, the diameter of the outer cam surface 90 is reduced slightly over a downslope 98. The downslope 98 leads to the stop diameter 96 and then a tip 100. As set forth in U.S. patent application Ser. No. 11/693,159, the downslope 98 to the stop diameter 96 is a surface to which the force from the at least one closing spring 61 is applied via a rocker arm assembly 110, discussed below, and which encourages rotation in the proper direction so that when the latch assembly 79 is released, the cam shaft 74 rotates and the rocker arm assembly 110 moves from the stop diameter 96 to the cam tip 100 where the cam follower 116 falls off the cam tip 100 and into the pocket of the cam 76. As is shown, the outer cam surface point of minimal diameter 92 and the outer cam tip 100 are disposed immediately adjacent to each other on the outer cam surface 90. Thus, there is a step 102 between the point of minimal diameter 92 and the cam tip 100. It is further noted that, due to the diameter of the rocker assembly cam follower 116 (discussed below) the rocker assembly cam follower 116 does not engage the point of minimal diameter 92, but rather engages a location immediately adjacent to the point of minimal diameter 92.

The rocker arm assembly 110 includes an elongated body 112 having a pivot point 114, a cam follower 116, and a ram body contact point 118. The rocker arm assembly body 112 is pivotally coupled to housing assembly 12 and/or side plates 27 at the rocker arm body pivot point 114. The rocker arm assembly body 112 may rotate about the rocker arm body pivot point 114 and is structured to move between a first position, wherein the rocker arm body ram body contact point 118 is disposed adjacent to a ram assembly base plate, and a second position, wherein the rocker arm body ram body contact point 118 is adjacent to a ram assembly stop plate. As used immediately above, "adjacent" is a comparative adjective relating to the positions of the rocker arm assembly body 112. The rocker arm body ram body contact point 118 is structured to engage and move the ram assembly 60 and thereby compress the at least one closing spring 61. The rocker arm assembly body 112 moves within a plane generally parallel to the plane of the side plates 27. The rocker arm body cam follower 116 extends generally perpendicular to the longitudinal axis of the rocker arm assembly body 112 and is structured to engage the outer cam surface 90. The rocker arm body cam follower 116 may include a roller 117. Thus, charging of the at least one closing spring 61 is accomplished by the rotation of the cam 76. The rotation of the cam 76 is arrested by a latch assembly 79 when the rocker arm body cam follower 116 is at the stop diameter 96 as discussed in U.S. patent application Ser. No. 11/693,159.

Rotation of the cam 76 is accomplished by using the handle assembly 80 or the motor assembly 82. The handle assembly 80 is coupled to the cam shaft 74 at a point between the cam shaft distal tip 75 and the at least one cam 76. The handle assembly 80 includes an elongated handle 120 and a ratchet assembly 122. As is known in the art, the handle 120 is coupled to the ratchet assembly 122. The ratchet assembly 122 is coupled to the cam shaft 74 and structured to rotate the cam shaft 74 in the charging direction (as indicated by the arrow on FIG. 2A). That is, the ratchet assembly 122 includes a rack of teeth (not shown) and a pawl (not shown). The rack of teeth is coupled, or fixed, to the cam shaft 74. The pawl is coupled to the handle 120 and, when the handle 120 is moved in a first direction, the pawl passes over the rack of teeth. When the handle 120 is moved in the opposite direction, the pawl engages the rack of teeth and causes the cam shaft 74 to rotate in the charging direction.

The motor assembly 82 includes a motor 130 and a shaft 132. The motor 130 is structured to rotate the motor shaft 132 in the charging direction. The motor shaft 132 has a distal end 134. When the motor assembly 82 is installed in the housing assembly 12, the axis of the motor shaft 132 is aligned with the cam shaft 74 with the motor shaft distal end 134 adjacent to the cam shaft distal tip 75. The motor shaft 132 and the cam shaft 74 are coupled by an over running clutch assembly 140. The motor assembly 82 may include two side plates 136 which are held in a spaced relation and which define a clutch space 138. The over running clutch assembly 140 is disposed in the clutch space 138 and together with the motor assembly 82 is removable from the housing assembly 12 as a unit. The motor assembly 82 preferably includes an electronic cutoff switch 139 (as discussed below).

The charging assembly 70 also includes an over running clutch assembly 140. The over running clutch assembly 140 includes a sprocket 142 and a hub assembly 144. The sprocket 142 is structured to be fixed to the motor shaft distal end 134. The sprocket 142 has a generally flat, disk-like body 146 having a central opening 148 and a radial outer surface 150 having a number of generally uniform teeth 152. Preferably, the teeth 152 are symmetrical about a central point having a generally smooth top 153 and a generally U-shaped sidewall 155 between the teeth tops 153. The U-shaped sidewall 155 has a descending side 157 and an ascending side 159, as described below. The teeth 152 may also be jagged (not shown) in a manner similar to the teeth on a ratchet rack. The sprocket central opening 148 preferably has a non-circular shape, such as a D shape as shown. The motor shaft 132 has a shape corresponding to the shape of the sprocket central opening 148 and, as such, when the sprocket 142 is coupled to the motor shaft 132 with the motor shaft 132 extending into, or through, the sprocket central opening 148, the sprocket 142 is fixed to the motor shaft 132 and rotates therewith. The sprocket 142 also includes a collar 154. The collar 154 is, essentially, a circular cap that is disposed over the end of the motor shaft 132.

The hub assembly 144 is structured to be disengagably fixed to the cam shaft 74 and rotatably coupled to the sprocket 142. The hub assembly 144 includes a hub body 160 and a link assembly 170. The hub body 160 is generally planar with a first face 162 and a second face 164. The hub body 160 further includes a link assembly mounting point 166, a sprocket socket 167, and a cam shaft socket 168. The sprocket socket 167 is disposed on the first face 162. The sprocket socket 167 is generally circular and sized to correspond to the size of the collar 154. That is, the collar 154 may be rotatably disposed within the sprocket socket 167. The cam shaft socket 168 is disposed on the second face 164. The cam shaft socket 168 has a shape that corresponds to the shape of the cam shaft distal tip 75 which, as shown, is preferably a D shape. The center of the sprocket socket 167 and the center of the cam shaft socket 168 are aligned and define an axis of rotation for the hub body 160.

The link assembly 170 includes a link member 172 having an elongated body 174, a spring 176 and a pawl 178. The link member elongated body 174 has a first end 180 and a pivot mounting 182. The link member elongated body 174, as described below, is coupled to the hub body 160 and the longitudinal axis of the link member elongated body 174 extends in a plane generally parallel to the plane of the hub body 160. The pawl 178 is disposed at the link member body first end 180. The pawl 178 extends in a direction generally perpendicular to the plane of the hub body 160.

The hub assembly 144 is assembled as follows. The link member elongated body 174 is pivotally coupled to the hub body 160. More specifically, the link member elongated body pivot mounting 182 is coupled to the link assembly mounting point 166. The link assembly spring 176 is disposed between, and coupled to both, the link member elongated body 174 and the hub body 160. The link assembly spring 176 is structured to bias the link member body first end 180 towards the hub body 160. Thus, the pawl 178 is also biased toward the hub body 160. The pawl 178, as well as the link member 172, is structured to move between a first position, wherein the pawl 178 engages the sprocket radial outer surface 150, and a second position, wherein the pawl 178 does not engage the sprocket radial outer surface 150. Movement of the pawl 178 into the second position is detailed in concurrently filed U.S. patent application Ser. No. 11/733,465, filed Apr. 10, 2007, entitled "MOTOR OPERATOR DE-COUPLING SYSTEM SENSING CAMSHAFT POSITION". As set forth below, when the pawl 178 is in the first position, the pawl 178 may move over the sprocket radial outer surface 150 when the hub assembly 144 is rotated in the charging direction.

The over running clutch assembly 140 is assembled as follows. The hub assembly 144 is rotatably coupled to the sprocket 142. That is, the collar 154 is disposed within the sprocket socket 167. Because the collar 154 and the sprocket socket 167 are both generally circular, the hub assembly 144 may rotate relative to the sprocket 142. The hub body 160 and the sprocket body 146 extend, generally, in parallel planes. Thus, the pawl 178 extends perpendicularly toward the sprocket body 146 and engages the teeth 152. Further, relative to the charging direction, the link assembly mounting point 166 is disposed behind the pawl 178. The link assembly mounting point 166 is also disposed so that, when the pawl 178 is disposed between the sprocket teeth tops 153, that is, when the pawl 178 is disposed over the U-shaped sidewall 155 between the teeth tops 153, a line extending between the link assembly mounting point 166 and the pawl 178 intersects the descending side 157 of the U-shaped sidewall 155 where the pawl 178 is located.

In this configuration, the hub assembly 144 may only rotate in the charging direction relative to the sprocket 142. That is, the pawl 178 moves over the sprocket outer surface 150 in a single direction, the charging direction. Given this direction of motion of the pawl 178, the U-shaped sidewall 155 may be said to have a descending side 157 and an ascending side 159. As the pawl 178 moves over a tooth top 153 and enters the U-shaped sidewall 155, the pawl 178 "descends" over the descending side 157. When the pawl 178 moves out of the U-shaped sidewall 155, the pawl 178 "ascends" over the ascending side 159. It is noted that, due to the position of the link assembly mounting point 166, as described above, the descending side 157 is generally perpendicular to the line extending between the link assembly mounting point 166 and the pawl 178. However, due to the curvature of the sprocket 142, the line extending between the link assembly mounting point 166 and the pawl 178 may not cross over the ascending side 159, or, if the line extending between the link assembly mounting point 166 and the pawl 178 does cross over the ascending side 159, the line does so at an angle of less than about 80 degrees.

Thus, when a rotational force is applied to the hub assembly 144 in the charging direction, the force applied to the link member elongated body 174 overcomes the bias of the link assembly spring 176 and the pawl 178 moves over the sprocket outer surface 150. More specifically, the rotational force causes a force on the pawl 178 that acts along the line extending between the link assembly mounting point 166 and the pawl 178. When the rotation force is applied in the charging direction, the resulting force on the pawl 178 acts in a direction away from the link assembly mounting point 166. Because this force is acting along a line that does not intersect, or intersects at an angle, the ascending side 159, the pawl 178 may move over the sprocket outer surface 150. Thus, when a rotational force in the charging direction is applied to the hub assembly 144, e.g. a force created by a user operating the handle assembly 80, the hub assembly 144 rotates in the charging direction relative to the sprocket 142.

When a rotational force is applied to the hub assembly 144 opposite the charging direction, the force applied to the link member elongated body 174 does not overcome the bias of the link assembly spring 176 and the pawl 178 cannot move over the sprocket outer surface 150. That is, due to the position of the link assembly mounting point 166, as set forth above, a rotational force applied to the hub assembly 144 in a direction opposite the charging direction causes the pawl 178 to engage, or be pulled against, the U-shaped sidewall 155 where the pawl 178 is located. That is, the force on the pawl 178 acts in a line between the pawl 178 and the link assembly mounting point 166. As set forth above, this line intersects the descending side 157 at about a right angle. Thus, the force is, essentially, directed into the sprocket 142 and as such, the force cannot overcome the bias of the link assembly spring 176 and the pawl 178 cannot move out of the U-shaped sidewall 155. It is further noted that when the sprocket 142 is rotated by the motor 130 in the charging direction, the forces applied to the hub assembly 144 are similar to applying a rotational force to the hub assembly 144 opposite the charging direction. Thus, when the motor 130 rotates the sprocket 142, the hub assembly 144 rotates with the sprocket 142 in the charging direction.

Finally, as noted above, the cam shaft socket 168 and the cam shaft distal tip 75 have corresponding shapes, preferably a D shape. The cam shaft distal tip 75 may be inserted, or removed, from the cam shaft socket 168. Because the cam shaft socket 168 and the cam shaft distal tip 75 are non-circular, when the components are coupled, the components will move in a fixed orientation relative to each other. That is, the cam shaft socket 168 may be disengagably fixed to the cam shaft distal tip 75. Alternately stated, the cam shaft 74 is disengagably fixed to the hub assembly 144. Thus, the motor assembly 82 and the over running clutch assembly 140 may be removed or installed as a unit from the housing assembly 12.

In operation, in this configuration, the handle assembly 80 is structured to rotate the cam shaft 74 and the hub assembly 144, with the hub assembly 144 rotating on the sprocket 142. Further, the motor assembly 82 is structured to rotate the cam shaft 74, the hub assembly 144 and the sprocket 142, with the hub assembly 144 rotating with the sprocket 142.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. An over running clutch assembly for an electrical switching apparatus operating mechanism, said operating mechanism having at least one closing spring that is coupled to, and structured to be compressed by, a cam disposed on a cam shaft, said cam shaft being engaged by a handle assembly, a motor assembly having a motor shaft extending therefrom and structured to rotate upon actuation of said motor, said motor shaft having a distal end, said over running clutch assembly comprising:

a sprocket structured to be fixed to said motor shaft distal end;

a hub assembly structured to be disengagably fixed to said cam shaft, said hub assembly rotatably coupled to said sprocket and structured to rotate in a single, first direction about said sprocket;

wherein, when said cam shaft is disengagably fixed to said hub assembly, said handle assembly is structured to rotate said cam shaft and said hub assembly, said hub assembly rotating on said sprocket; and wherein, when said cam shaft is disengagably fixed to said hub assembly, said motor assembly shaft is structured to rotate said cam shaft, said hub assembly and said sprocket, said hub assembly rotating with said sprocket.

2. The over running clutch assembly of claim 1 wherein:

said hub assembly includes a hub body, a spring and movable pawl;

said pawl structured to move between a first position, wherein said pawl engages said sprocket and fixes said hub assembly to said sprocket, and a second position wherein said pawl passes over said sprocket;

said spring coupled to said hub body and said pawl, said spring structured to bias said pawl to said first position; and wherein said pawl is structured to be responsive to the rotation of said cam shaft and said motor shaft so that when said cam shaft moves in said first direction, said pawl overcomes the bias of said spring and moves to said second position, and when said motor shaft moves in said first direction, said pawl does not overcome the bias of said spring and remains in the first position.

3. The over running clutch assembly of claim 2 wherein:

said hub body is a generally planar body, said hub body extending in a direction generally perpendicular to the axis of rotation of said cam shaft and said motor shaft;

said hub assembly includes a link assembly;

said hub body having a link assembly mounting point;

said link assembly includes said pawl, said spring and an elongated link member;

said link member having an elongated body with a first end and a pivot mounting;

said link member being pivotally coupled to said hub body at said link assembly mounting point, said link member extending in a plane generally parallel to said hub body;

said pawl disposed adjacent to said link member first end, said pawl extending generally perpendicular to said link member; and wherein said link member moves between a first position, wherein said pawl engages said sprocket and fixes said hub assembly to said sprocket, and a second position wherein said pawl passes over said sprocket.

4. The over running clutch assembly of claim 3 wherein:

said hub body has a center of rotation, a first face, a second face, a sprocket socket, and a cam shaft socket;

said sprocket socket disposed at said center of rotation and on said first face;

said cam shaft socket disposed at said center of rotation and on said second face; and said link assembly mounting point located at a point behind said pawl relative to said first direction.

5. The over running clutch assembly of claim 4 wherein said sprocket has outer surface and a plurality of generally uniform teeth on said outer surface.

6. The over running clutch assembly of claim 4 wherein said cam shaft has a distal tip with a non-circular shape and wherein:

said cam shaft socket has a non-circular shape;

said cam shaft distal tip structured to be disposed in said cam shaft socket;

said sprocket includes a circular extending collar;

said sprocket socket has a circular shape; and said sprocket collar disposed in said sprocket socket.

7. A charging assembly for an electrical switching apparatus operating mechanism, said operating mechanism having at least one closing spring that is structured to be compressed by a rocker arm assembly, said charging assembly comprising:

a cam disposed on a cam shaft, said cam structured to engage said rocker arm assembly;

a handle assembly having an elongated handle and a ratchet assembly;

said handle coupled to said ratchet assembly;

said ratchet assembly coupled to said cam shaft and structured to rotate said cam shaft in a first direction;

a motor assembly have a motor shaft extending therefrom, said motor assembly structured to rotate said motor shaft in a first direction, said motor shaft having a distal end;

said cam shaft coupled to said motor shaft by an over running clutch assembly, said over running clutch assembly having a sprocket and a hub assembly;

said sprocket fixed to said motor shaft distal end;

said hub assembly structured to be disengagably fixed to said cam shaft, said hub assembly rotatably coupled to said sprocket and structured to rotate in a single, first direction about said sprocket;

wherein, when said cam shaft is disengagably fixed to said hub assembly, said handle assembly is structured to rotate said cam shaft and said hub assembly, said hub assembly rotating on said sprocket; and wherein, when said cam shaft is disengagably fixed to said hub assembly, said motor assembly shaft is structured to rotate said cam shaft, said hub assembly and said sprocket, said hub assembly rotating with said sprocket.

8. The charging assembly of claim 7 wherein:

said hub assembly includes a hub body, a spring and movable pawl;

said pawl structured to move between a first position, wherein said pawl engages said sprocket and fixes said hub assembly to said sprocket, and a second position wherein said pawl passes over said sprocket;

said spring coupled to said hub body and said pawl, said spring structured to bias said pawl to said first position; and wherein said pawl is structured to be responsive to the rotation of said cam shaft and said motor shaft so that when said cam shaft moves in said first direction, said pawl overcomes the bias of said spring and moves to said second position, and when said motor shaft moves in said first direction, said pawl does not overcome the bias of said spring and remains in the first position.

9. The charging assembly of claim 8 wherein:

said hub body is a generally planar body, said hub body extending in a direction generally perpendicular to the axis of rotation of said cam shaft and said motor shaft;

said hub assembly includes a link assembly;

said hub body having a link assembly mounting point;

said link assembly includes said pawl, said spring and an elongated link member;

said link member having an elongated body with a first end and a pivot mounting;

said link member being pivotally coupled to said hub body at said link assembly mounting point, said link member extending in a plane generally parallel to said hub body;

said pawl disposed adjacent to said link member first end, said pawl extending generally perpendicular to said link member; and wherein said link member moves between a first position, wherein said pawl engages said sprocket and fixes said hub assembly to said sprocket, and a second position wherein said pawl passes over said sprocket.

10. The charging assembly of claim 7 wherein:

said hub body has a center of rotation, a first face, a second face, a sprocket socket, and a cam shaft socket;

said sprocket socket disposed at said center of rotation and on said first face;

said cam shaft socket disposed at said center of rotation and on said second face; and said link assembly mounting point located at a point behind said pawl relative to said first direction.

11. The charging assembly of claim 10 wherein said sprocket has outer surface and a plurality of generally uniform teeth on said outer surface.

12. The charging assembly of claim 10 wherein:

said cam shaft has a distal tip with a non-circular shape;

said cam shaft socket has a non-circular shape;

said cam shaft distal tip disposed in said cam shaft socket;

said sprocket includes a circular extending collar;

said sprocket socket has a circular shape; and said sprocket collar disposed in said sprocket socket.

13. An electrical switching apparatus comprising:

a housing assembly having at least one side plate, said housing assembly defining an enclosed space;

an operating mechanism disposed in said housing assembly enclosed space and having at least one closing spring that is structured to be compressed by a rocker arm assembly;

a charging assembly having a rocker arm assembly, a cam, a cam shaft, a handle assembly, an over running clutch assembly, and a motor assembly;

said rocker arm assembly having an elongated body, said rocker arm assembly body being pivotally coupled to said at least one side plate and structured to engage said at least one spring, said rocker arm assembly body further structured to engage said cam and move in response to a rotation of said cam;

said cam disposed on said cam shaft, said cam structured to engage said rocker arm assembly;

a handle assembly having an elongated handle and a ratchet assembly;

said handle coupled to said ratchet assembly;

said ratchet assembly coupled to said cam shaft and structured to rotate said cam shaft in a first direction;

a motor assembly have a motor shaft extending therefrom, said motor assembly structured to rotate said motor shaft in a first direction, said motor shaft having a distal end;

said cam shaft coupled to said motor shaft by said over running clutch assembly, said over running clutch assembly having a sprocket and a hub assembly;

said sprocket fixed to said motor shaft distal end;

said hub assembly structured to be disengagably fixed to said cam shaft, said hub assembly rotatably coupled to said sprocket and structured to rotate in a single, first direction about said sprocket;

wherein, when said cam shaft is disengagably fixed to said hub assembly, said handle assembly is structured to rotate said cam shaft and said hub assembly, said hub assembly rotating on said sprocket; and wherein, when said cam shaft is disengagably fixed to said hub assembly, said motor assembly shaft is structured to rotate said cam shaft, said hub assembly and said sprocket, said hub assembly rotating with said sprocket.

14. The electrical switching apparatus of claim 13 wherein:

said hub assembly includes a hub body, a spring and movable pawl;

said pawl structured to move between a first position, wherein said pawl engages said sprocket and fixes said hub assembly to said sprocket, and a second position wherein said pawl passes over said sprocket;

said spring coupled to said hub body and said pawl, said spring structured to bias said pawl to said first position; and wherein said pawl is structured to be responsive to the rotation of said cam shaft and said motor shaft so that when said cam shaft moves in said first direction, said pawl overcomes the bias of said spring and moves to said second position, and when said motor shaft moves in said first direction, said pawl does not overcome the bias of said spring and remains in the first position.

15. The electrical switching apparatus of claim 14 wherein:

said hub body is a generally planar body, said hub body extending in a direction generally perpendicular to the axis of rotation of said cam shaft and said motor shaft;

said hub assembly includes a link assembly;

said hub body having a link assembly mounting point;

said link assembly includes said pawl, said spring and an elongated link member;

said link member having an elongated body with a first end and a pivot mounting;

said link member being pivotally coupled to said hub body at said link assembly mounting point, said link member extending in a plane generally parallel to said hub body;

said pawl disposed adjacent to said link member first end, said pawl extending generally perpendicular to said link member; and wherein said link member moves between a first position, wherein said pawl engages said sprocket and fixes said hub assembly to said sprocket, and a second position wherein said pawl passes over said sprocket.

16. The electrical switching apparatus of claim 15 wherein:

said hub body has a center of rotation, a first face, a second face, a sprocket socket, and a cam shaft socket;

said sprocket socket disposed at said center of rotation and on said first face;

said cam shaft socket disposed at said center of rotation and on said second face; and said link assembly mounting point located at a point behind said pawl relative to said first direction.

17. The electrical switching apparatus of claim 16 wherein said sprocket has outer surface and a plurality of generally uniform teeth on said outer surface.

18. The electrical switching apparatus of claim 16 wherein:

said cam shaft has a distal tip with a non-circular shape;

said cam shaft socket has a non-circular shape;

said cam shaft distal tip disposed in said cam shaft socket;

said sprocket includes a circular extending collar;

said sprocket socket has a circular shape; and said sprocket collar disposed in said sprocket socket.

* * * * *